United States Patent [19]

Culver et al.

[11] 4,132,098

[45] Jan. 2, 1979

[54] COLD-ROLLING OF LARGE DIAMETER GEARS

[75] Inventors: Irven H. Culver, Playa Del Rey; Oleg Szymber, Rancho Palos Verdes, both of Calif.

[73] Assignee: Southwestern Industries, Inc., Los Angeles, Calif.

[21] Appl. No.: 801,110

[22] Filed: May 27, 1977

[51] Int. Cl.[2] ..... B21H 5/02

[52] U.S. Cl. ..... 72/102; 29/159.2

[58] Field of Search ..... 72/102, 195; 29/159.2; 51/105 GG, DIG. 1

[56] References Cited

U.S. PATENT DOCUMENTS

| | | | |
|---|---|---|---|
| 1,001,799 | 8/1911 | Anderson | 72/102 |
| 1,240,915 | 9/1917 | Anderson | 72/32 |
| 2,883,894 | 4/1959 | Tsuchikawa | 29/159.2 |

*Primary Examiner*—Lowell A. Larson

*Attorney, Agent, or Firm*—Christie, Parker & Hale

[57] ABSTRACT

A back-gear set is coupled between a gear forming roll and a gear blank into the virgin surface of which gear teeth are cold-rolled by forceful engagement of the roll with the blank. The blank and the roll are rotatable about axes which are movable relative to each other for infeed of the roll into the blank during cold-forming of the gear teeth in the blank. The back-gears are defined in cooperation with the infeed drive mechanism so that, at the time of contact of the roll with the blank, the blank and roll rotate at a ratio of angular velocities, and the ratio is not changed during infeed of the roll into the blank during cold-forming of teeth in the blank.

10 Claims, 4 Drawing Figures

(1) $d_1 \overline{>} d_2$ (2) $r_D \neq r_I$ (3) $r_D > r_B$ (4) $D_B < \frac{D_R \times N_B}{N_R}$

COLD-ROLLING OF LARGE DIAMETER GEARS

BACKGROUND OF THE INVENTION

1. Field of the Invention

This invention relates to gear forming. More particularly, it pertains to cold-rolling of gear teeth in a virgin, i.e., substantially smooth, surface of a relatively large diameter gear blank by a forming roll in which all teeth are identical and are conjugate to the teeth to be found in the blank.

2. Review of the Prior Art

Commonly owned U.S. Pat. No. 3,877,273 describes method and apparatus for forming, solely by a cold-rolling operation, fully-finished gear teeth in a virgin surface of a gear blank. A virgin surface, in the context of both the prior patent and the present invention, means the surface of the blank into which gear teeth are to be formed and which, prior to the beginning of the cold-rolling operation, does not define either rudimentary gear teeth (as compared with gear cold-rolling processes alternative to gear shaving, for example) or depressions or other features indicative of the spacing between adjacent ones of the teeth to be formed. U.S. Pat. No. 3,877,273 describes such cold-rolling of gears both in terms of gears sufficiently small that they are formed in a centerless rolling machine and in terms of relatively larger gears having sufficient intrinsic structural strength to permit the gear rolling operation to occur in a lathe or chucking machine. This invention pertains to gears of the latter class, i.e., gears formed in blanks of sufficient strength as not to require use of centerless cold-rolling techniques.

The large gear cold-rolling apparatus and procedures described in U.S. Pat. No. 3,877,273 with reference to FIGS. 1–3 thereof are fully effective. The use of these apparatus and procedures, however, requires that the blank, into which gear teeth are to be cold-rolled, be very precisely fabricated. The diameter of the blank must be defined with great precision; a gear blank only slightly oversize or undersize will result in the generation of either too many or too few teeth or in the generation of significantly inaccurate teeth. Precision machining operations are costly, both in terms of the time required for their proper performance, in terms of the prevailing wages paid to persons of the requisite levels of skill, and in terms of the machines needed to perform such operations. A principal advantage of cold-rolling gear forming procedures is that they are not labor intensive and are comparatively fast, and thus are less costly than other gear forming techniques. The need for precision fabrication of gear blanks offsets the beneficial economic advantage of the gear rolling procedures described in the prior patent.

A need exists for a cold-rolling gear forming apparatus and procedure which is useful with relatively large diameter gear blanks and which is not dependent on the gear blanks being fabricated to high levels of precision, especially as to diameter.

SUMMARY OF THE INVENTION

This invention addresses and satisfies the need identified above. This invention makes it possible to effectively form gear teeth, entirely by a cold-rolling operation, in a gear blank which can be fabricated with substantially less precision than heretofore was acceptable. This invention, therefore, enables industry to more fully realize the economic benefits of cold-rolling operations in the manufacture of gears.

Generally speaking, this invention provides apparatus for rolling gear teeth in a rotatable metal gear blank by forceful engagement of the blank by an appropriately profiled forming roll. The apparatus includes mounting means for mounting the blank and the roll for rotation about first and second axes, respectively. Means are coupled to one of the blank and the roll adapting the same to be rotated about its axis. Drive means are coupled to one of the axes for moving the one axis in a translatory manner relative to the other axis during rotation of the one of the blank and the roll, thereby to move the blank and the roll into engagement with each other sufficiently forcefully to cause the roll to form gear teeth in the blank. Gear means are coupled between the blank and the roll for rotating the blank and the roll about the respective axes in response to rotation of the one of the blank and the roll.

The gear means comprises a first gear which is affixed to the blank for rotation with the blank about the first axis. The gear means includes a second gear which is affixed to the roll for rotation with the roll about the second axis and for meshing with the first gear. The teeth on the first and second gears are cooperatively defined so that the ratio of the angular velocities of the gears about their respective axes is constant during meshing of the gears independently of the distance between the gear axes.

DESCRIPTION OF THE ILLUSTRATED EMBODIMENTS

Figure 1:
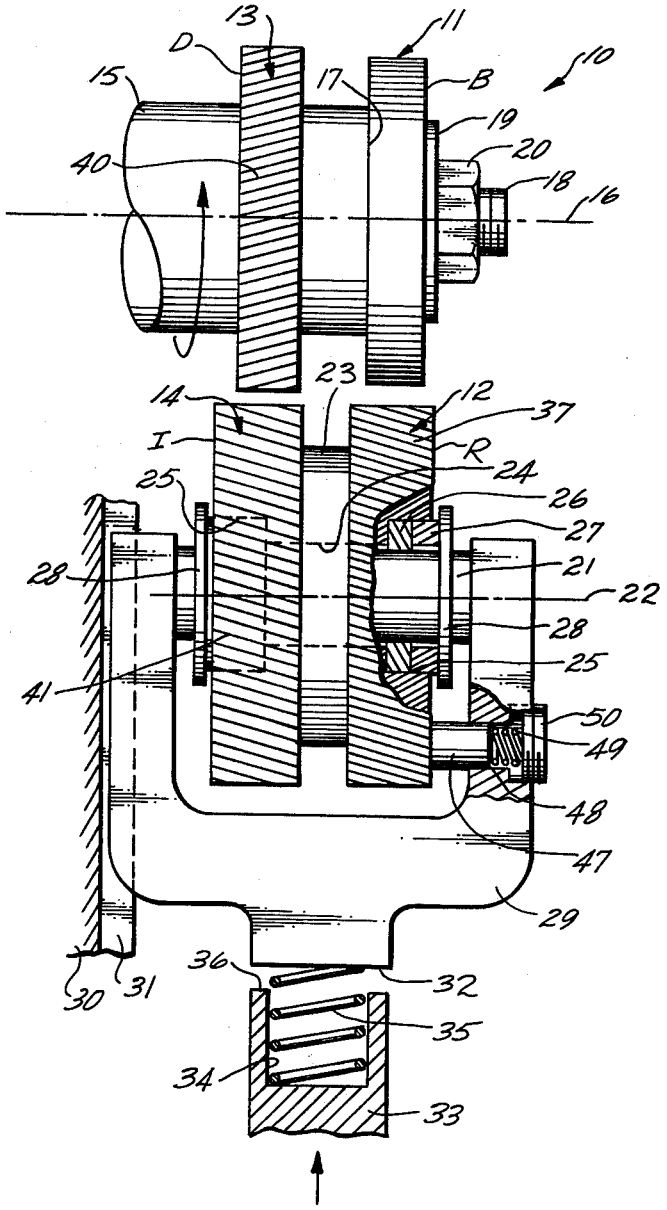
FIG. 1 is a simplified elevation view, partially in cross-section, of gear rolling apparatus according to this invention.

FIG. 1 shows gear rolling apparatus 10 which includes a gear blank 11, a forming roll 12, a driving back-gear 13, and an idling (driven) back-gear 14. In FIG. 1, elements 11, 12, 13 and 14 are additionally identified by the letter reference characters B, R, D and I, respectively, for ease of reference and ready location in FIG. 1. The peripheral surface of the blank is smooth and is the virgin surface into which gear teeth are to be cold-rolled by roll 12.

Driving back-gear 13 preferably is formed integral with a shaft 15 adjacent one end of the shaft, the other end of the shaft being adapted to be secured in the live spindle of a lathe or the chuck of a chucking machine, for example, for rotation about axis 16 which is a fixed axis in apparatus 10. Driving gear 13 is defined in a collar which is greater in diameter than the basic diameter of shaft 15, the collar being located adjacent an end face 17 of the shaft from which a threaded stud 18 extends along axis 16. Gear blank 11 is axially bored to be insertable upon stud 18 and to be held clamped securely against shaft end face 17 by a washer 19 and a nut 20 engaged with stud 18. In this manner, blank 11 is mounted to shaft 15 in fixed relation to driving gear 13 so that the blank and the driving gear rotate as a unit about axis 16. If desired in the case of larger diameter blanks than that illustrated in FIG. 1, a dog pin may protrude from shaft end face 17 to be keyed into a suitable hole drilled in a gear blank.

Forming roll 12 and idling back-gear 14 are formed as a unit for rotation together about a supporting axle 21 having an axis 22. Preferably the forming roll and the idling back-gear are defined on collars formed at the opposite ends of a relatively large diameter shaft 23. Shaft 23 has an axial bore 24 which is enlarged at its opposite ends to form recesses 25. A journal bearing 26 and a thrust bearing 27 are disposed in each of the recesses 25 so that the thrust bearings extend out of the recesses along axle 21 for cooperation with thrust collars 28 secured to the axle adjacent the opposite end faces of shaft 23. Journal bearings 26 rotatably mount shaft 23 on axle 21, whereas thrust bearings 27 hold the shaft from movement axially along axle 21.

Axle 21 is mounted securely between the legs of a yoke 29. The yoke leg adjacent to idling back-gear 14 is movably mounted to support 30 by a dovetail guide rail 31 which cooperates with a suitably configured slot formed in the yoke member perpendicular to axis 22. Dovetail guide rail 31 is disposed perpendicular to axis 16 so that axis 22 is parallel to axis 16 and is relatively movable in a purely translatory manner (i.e., always parallel to axis 16) toward and away from axis 16 for movement of back-gears 13 and 14 into engagement with each other and thereafter for engagement of forming roll 12 with gear blank 11 during continued infeed motion of axis 22 toward axis 16. It is not important whether the path of translatory movement of axis 22 is a straight path or an arcuate path; in apparatus 10, this path is straight.

Yoke 29 is moved toward axis 16 by a drive member 33 which is aligned with a face 32 defined on the end of yoke 29 opposite from axis 16. Preferably drive member 33 is reciprocable along a line perpendicular to axis 22, which line passes centrally between the forming roll and driven back-gear 14. The end of drive member 33 adjacent the yoke is recessed, as at 34, to receive a compression spring 35. Initial infeed motion of drive member 33 toward axis 16 causes yoke 29 to be urged toward shaft 15 with a force determined by the extent of compression of spring 35 and the stiffness of the spring. Ultimately, however, the end face 36 of drive member 33 contacts face 32 of yoke 29 so that the position of the yoke relative to axis 16 and the force of engagement of forming roll 12 with gear blank 11 are determined by the position of drive member 33. It will thus be apparent that gear rolling apparatus 10 incorporates the "soft start" feature which is encountered in gear rolling apparatus according to the disclosures of commonly owned U.S. Pat. No. 3,877,273. In this manner, during gear rolling operations with apparatus 10, the ultimate cold-rolling force of engagement of forming roll 12 with gear blank 11 is developed gradually over several rotations of gear blank 11 as a result of the cooperative relationship between the rate of advance of drive member 33 and the angular velocity of gear blank 11 about its axis 16.

A plurality of forming teeth 37 are formed in the periphery of forming roll 12. Teeth 37 are contoured to be conjugate to the teeth ultimately to be formed in gear blank 11. As shown in FIG. 1, forming teeth 37 are helical teeth each of which has its elongate extent aligned along a helix about axis 22. Workers skilled in the art to which this invention pertains will readily recognize, however, that forming teeth 37 may be spur teeth having their elongate extents, between the opposite end faces of forming roll 12, aligned parallel to axis 22.

Preferably forming roll 12 and driven back-gear 14 are of substantially equal diameter. The diameter of the forming roll preferably is different from, and most preferably greater than the diameter of gear blank 11 according to a ratio between the diameters of the forming roll and the gear blank which approaches an irrational number. In this manner, individual forming teeth 37 contact gear blank 11 during the gear forming operation at different points along the circumference of the blank to cause any errors in forming teeth 37 to be averaged over the teeth formed in blank 11. However, if errors averaging is not desired, the diameter of the blank and the forming roll can be equal.

Gear blank 11 has a diameter which is less than the diameter of driving back-gear 13. In this manner back-gears 13 and 14 engage each other before forming roll 12 contacts the virgin circumferential surface of gear blank 11 in response to infeed motion of drive member 33. Thus, at the time the forming roll and the gear blank make contact with each other, these two elements of apparatus 10 are rotating at a predetermined ratio of angular velocities, which ratio is defined by the gear ratio of back-gears 13 and 14.

In a gear rolling apparatus according to this invention, the back-gears and the drive means for moving axes 22 and 16 relative to each other are cooperatively related so that the ratio of angular velocities existing between the forming roll and the gear blank at the time of first contact of the forming roll with the gear blank does not change during further infeed motion of the forming roll toward the gear blank. In apparatus 10, this situation is controlled principally by the shape of the teeth formed on the back-gears, and also by the spacing between the teeth on one of the back gears relative to the spacing of the teeth on the other back-gear. In the gear rolling apparatus shown in FIG. 4, this situation is controlled by the geometry of the mounting of the forming roll and its back-gear relative to the gear blank and its back-gear, and by the manner in which the drive means associated with the forming roll moves the forming roll axis relative to the gear blank axis.

Figures 2, 3:
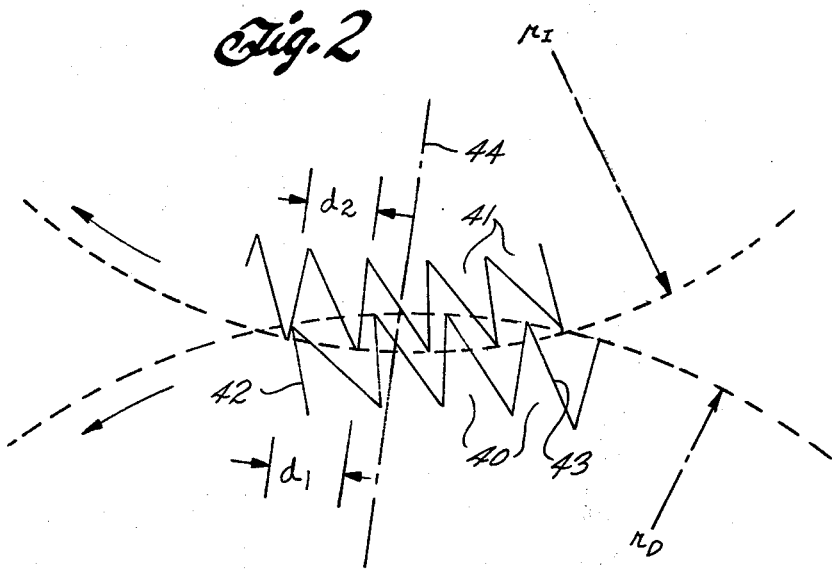
FIG. 2 is a greatly enlarged, fragmentary and simplified illustration of the cooperation between the back-gears in the preferred gear rolling apparatus shown in FIG. 1.
FIG. 3 is a table of geometrical relationships which preferably exist in a gear rolling apparatus according to this invention.

As shown in FIG. 1, but in greater detail in FIG. 2, driving back-gear 13 and idling back-gear 14 define a plurality of teeth 40 and 41 about their respective circumferences. Because forming teeth 37 of forming roll 12 are helical teeth, teeth 41 on idling back-gear 14 are also helical teeth, the helices associated with teeth 37 and 41 being of equal pitch and in the same direction about axis 22. Thus, axial motion of forming roll 12 along axis 22 does not produce variation in the instantaneous angular velocity of the forming roll relative to the gear blank. Obviously, since teeth 41 are helical teeth, teeth 40 on driving back-gear 13 are also helical teeth.

Teeth 40 and 41 are defined on back-gears 13 and 14, respectively, with zero effective pressure angle on the faces thereof which are engaged during operation of apparatus 10. In other words, as shown in FIG. 2, teeth 40 and 41 are of sawtooth configuration in which the teeth on each back-gear have a contacting face 42 which is disposed radially of the axis of the respective back-gear but for the helical form of the tooth. That is, in any given reference plane through a back-gear perpendicular to the axis of rotation of that gear, the lines of intersection of the contacting faces 42 of the several teeth on that gear with the reference plane are lines radially of the axis of rotation of that gear. Each tooth has a sloping rear face 43 which is not a contacting face. The depth of teeth 40 and 41 is at least equal to the sum of (a) the difference between the radii of driven gear 13 and blank 11, and (b) the depth of forming teeth 37. This aspect of teeth 40 and 41 assures that the ratio of the angular velocity of gears 13 and 14 does not change as gear 14 is moved into increasing mesh with gear 13.

The sawtooth teeth on back-gears 13 and 14 preferably are arranged, as is shown in FIG. 2, so that the teeth in mesh engage each other only as the teeth tend to move apart from each other in response to rotation of the gears. Preferably, only a minimum number of teeth are in mesh. It follows, therefore, that the teeth in acutal contact with each other occupy a position on the downstream side of a reference plane 44 common to axes 16 and 22. Further, as shown in FIG. 2, in a manner which is greatly exaggerated for the sake of clarity, the peak-to-peak spacing $d_1$ between the teeth on the driving back-gear preferably is greater than, but it can be equal to, the peak-to-peak spacing $d_2$ on the driven back-gear 14. This relationship is shown in the table of FIG. 3 as relation (1) together with the other relations mentioned above, namely, (2) that the radii of the driving and driven back-gears to the peaks of the respective teeth on those gears are not equal radii, and (3) that the radius of the driving back-gear 13 is greater than the radius of the gear blank 11 as the gear blank is initially defined preparatory to the cold-rolling tooth forming operation. The difference between $d_2$ and $d_1$ over, say, four teeth may be about 0.0002 inch. $d_2$ equal to $d_1$ is acceptable, but $d_2$ less than $d_1$ is not. Observance of relation (1) assures that the teeth on gears 13 and 14 do not contact each other at their peaks or on surfaces 43, thereby preventing any change in phase angle between the gears after they are first meshed.

The driving back-gear 13 is made slightly larger in diameter than it should be for the gear ratio defined between the two back gears. For perfectly defined gears, the following relation exists:

$$N_D/N_I = D_D/D_I \quad (5)$$

In the case of the apparatus 10, however, the following relationship exists:

$$N_D D_I/N_I \leqq D_D \quad (6)$$

The number of teeth in the respective back-gears cannot practically be dealt with because the number of teeth is a discontinuous (periodic) function of the gears, and would change the effective gear ratio. Accordingly, the diameters of the back-gears are adjusted so that the driving back-gear 13 is slightly larger than it would otherwise be in order to comply with relationship (5). The slightly oversize preferred nature of the driving back-gear, together with the preferred relationship between the relative peak-to-peak spacing on the teeth of the back-gears, assures that the back-gears contact only on the downstream side of reference plane 44. That is, assuming for the sake of example that the back-gears are of equal diamter instead of different diameter as is preferred, these relationships assure that there is no change in the phase angle between the back-gears (either instantaneously or otherwise) during infeed of the forming roll toward the blank following mesh of the back-gears.

Further, as stated by relation (4) in FIG. 3, gear blank 11 is made slightly undersize on its effective pitch diameter, i.e., the diameter as initially machined or otherwise fabricated prior to commencement of the cold-rolling tooth formation operation. That is, gear blank 11 is made slightly undersize relative to that diameter which it would have to cause the correct number of teeth to be rolled thereon by forming roll 12 were no back-gears present in apparatus 10. This situation prevents any torsional feedback generated between the blank and the forming roll from being manifested between the back-gears in the wrong direction, i.e., in a direction tending to cause the idling back-gear to tend to lead the driving back-gear. If the blank diameter were greater than its theoretical diameter for cold-rolling in an apparatus without back-gears, such as an apparatus according to prior U.S. Pat. No. 3,877,273, then torsional feedback in the apparatus would be effective at the back-gears in a direction causing the driven back-gear 14 to tend to lead driving back-gear 13, thereby causing the teeth of the back-gears to tend to engage on their sloping faces 43, rather than their radial faces 42, as axis 22 is moved toward axis 16 during infeed motion of drive member 33. The tendency of the driven back-gear to tend to lead the driving back-gear destroys the desired phase angle synchronism between the forming roll and gear blank 11, as well as the blank and the back-gears.

Drag is applied to idler shaft 23 so that, during the interval between first engagement between the drive gears, but prior to engagement of forming roll 12 with gear blank 11 during infeed motion of drive member 33, back-gear 14 is always driven by back-gear 13 in response to rotation of shaft 15 and does not tend, at any time, to overrun back-gear 13. This drag is provided by a cylindrical plastic button 47 which is received in a bore 48 formed in the arm of yoke 29 adjacent to forming roll 12. The button is urged into contact with the adjacent face of the forming roll by a light compression spring 49 held captive between the button and an externally threaded plug 50 engaged in bore 48 at the end opposite from the forming roll.

The advantage of apparatus 10 is that it significantly enlarges the tolerance limit pertinent to the diameter of gear blank 11 as initially fabricated, so long as the actual diameter of the blank is less than the theoretical diameter of the blank according to relationship 4 shown in FIG. 3.

Figure 4:
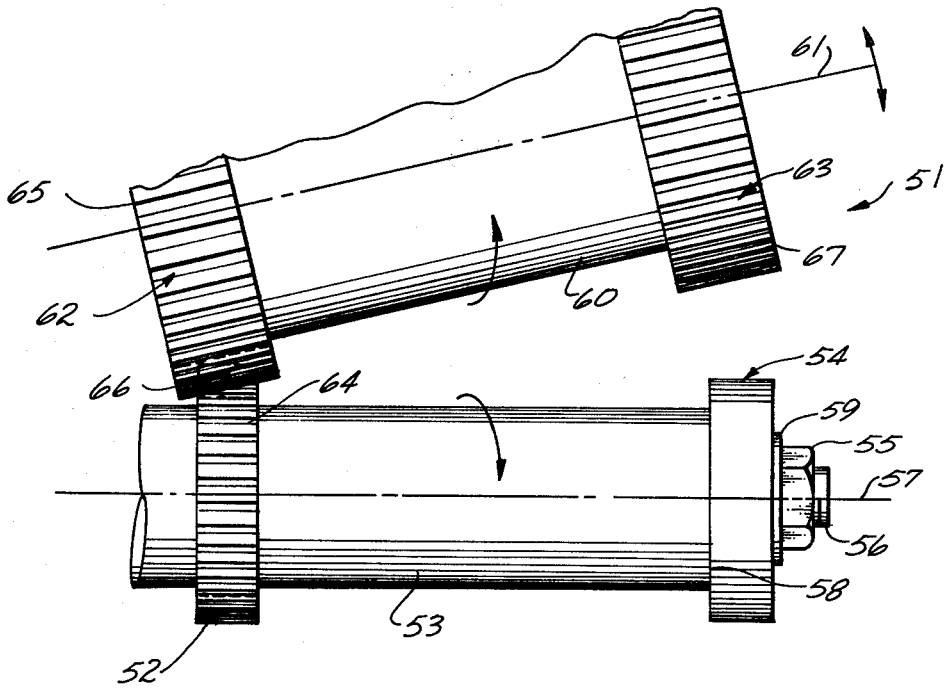
FIG. 4 is a simplified fragmentary view of another gear rolling apparatus.

Another gear rolling apparatus 51 according to this invention is shown in FIG. 4. A driving back-gear 52 is formed integral with a drive shaft 53 in the manner described above. A gear blank 54, having a smooth virgin peripheral surface into which gear teeth are to be cold-rolled, is secured to an end of drive shaft 53 by a nut 55 which is threaded into a stud 56. The stud extends along axis 57 of shaft 53 from a shaft end face 58 against which the blank is clamped by the nut and by a washer 59 between the nut and the blank. Axis 57 is fixed during operation of apparatus 51. The end of shaft 53 opposite from gear blank 59 is connected to a suitable drive mechanism for rotating the shaft about its axis.

An idler shaft 60 is rotatable about an axis 61 which is movable relative to axis 57. An idling back-gear 62 is affixed to idling shaft 60 for mating with driving back-gear 52, and a forming roll 63 is affixed to the idling shaft for engagement of its periphery with gear blank 54 in response to movement of axis 61 relative to axis 57 in the manner described below. The back-gear teeth are defined to accommodate pivotal motion between axes 57 and 61 and torque in either direction without backlash between the meshed teeth.

FIG. 4 illustrates that involute-form teeth may be used on back-gears 52 and 62. Involute toothed back-gears, however, cannot be used in apparatus 10 because involute toothforms on the back-gear teeth causes crawl (phase angle shift) of the driven back-gear relative to the driving back-gear, and also of the forming roll relative to the blank, as involute teeth are moved into mesh by purely translatory motion of the respective axes of rotation of the gears. To avoid the effects of crawl by reason of progressive mesh of involute back-gear teeth in apparatus 51, the teeth 64 and 65 of back-gears 52 and 62, respectively, have a fixed degree of mesh. This requires that axis 61 be moved in a pivotal manner relative to axis 57 as and after the forming roll makes contact with the gear blank during the operation in which gear teeth are cold-formed in blank 54 by forming roll 63. The point about which axis 61 pivots relative to axis 57 is point 66 shown in FIG. 4. Point 66 is defined so that the center of the contact area between the teeth of driving back-gear 52 meshes with the teeth of driven back-gear 65. That is, point 66 lies along a pivot axis which passes through the location at which the pitch diameters of gears 52 and 62 are tangent.

If the forming teeth 67 defined in the circumference of forming roll 63 are helical teeth, then teeth 65 of idling back-gear 62 are also helical teeth having the same pitch and sense (handedness about axis 61) as the forming teeth; the teeth on driving back-gear 52 are defined to mesh properly with teeth 65.

It follows from the foregoing comments that the mounting of idling shaft 60 for rotation about axis 61 and the mechanism for driving axis 61 toward axis 57 are arranged so that, at least after the instant that the forming roll and the gear blank first contact each other, there is no alteration in the degree of mesh of the back-gears. This means that at all times during contact of the forming roll with the gear blank, the ratio of angular velocities of the forming roll and gear blank does not change.

It is not necessary that relation (4), see FIG. 3, be observed in apparatus 51. Apparatus 51, as compared to apparatus 10, permits about twice the margin of error or tolerance in the initial diameter of blank 11. In apparatus 51, the blank initial diameter can be oversize or undersize within appropriate tolerance limits.

It is apparent that forming roll 63 and idling back-gear 62 should have essentially identical effective diameters and that the diameter of gear blank 54 should be substantially equal to the pitch diameter of driving back-gear 52.

Like apparatus 10, gear rolling apparatus 51 makes it possible to fabricate gear blanks with considerably less concern about the precision to which the diameter of the gear blank is defined.

Persons skilled in the art to which this invention pertains will recognize that the present invention has been described above with reference to a presently preferred geometrical arrangement of the essential elements of the apparatus, and to an alternate geometrical arrangement. Such persons will recognize that the embodiments of this invention which have been described are but two forms which devices according to this invention may take, and that modifications, alterations or variations in the structural arrangements described above, as well as in the procedures pertinent to the described apparatus, may be practiced without departing from the scope of this invention. For example, the shaft carrying the forming roll may be the driven shaft relative to the shaft carrying the gear blank, in which case the blank preferably is made slightly oversize relative to its theoretical diameter. Accordingly, the preceding description should not be construed as limiting or restricting the following claims only to the specific structural arrangements and procedures which have been described.

What is claimed is:

1. Apparatus for rolling gear teeth in a rotatable metal gear blank by forceful engagement of the blank by an appropriately profiled forming roll, the apparatus comprising mounting means for mounting the blank and the roll for rotation about first and second axes, respectively, means coupled to one of the blank and the roll adapting the same to be rotated about its axis, drive means coupled to one of the axes for moving the one axis in a translatory manner relative to the other axis during rotation of the one of the blank and the roll to move the blank and the roll into engagement with each other sufficiently forcefully to cause the roll to form gear teeth in the blank, and gear means coupled between the blank and the roll for rotating the blank and the roll about the respective axes in response to rotation of the one of the blank and the roll, the gear means comprising a first gear affixed to the blank for rotation with the blank about the first axis, and a second gear affixed to the roll for rotation with the roll about the second axis and for meshing with the first gear, the teeth on the first and second gears being cooperatively defined so that the ratio of the angular velocities of the gears about their respective axes is constant during meshing of the gears independently of the distance between the axes.

2. Apparatus according to claim 1 wherein the blank has a virgin surface in which teeth are to be formed, and the blank in the portion thereof defining the virgin surface is slighly undersize relative to the size the blank would have to cause the correct number of teeth to be formed therein by the roll in the absence of the first and second gears.

3. Apparatus according to claim 1 wherein the roll is profiled to define helical forming teeth in the circumference thereof and the second gear has helical teeth having the same pitch and sense as the forming teeth.

4. Apparatus according to claim 1 wherein the gear teeth are arranged for mesh of only one tooth at a time on one gear with the other gear.

5. Apparatus according to claim 4 wherein the position of the meshing teeth of the gears is located on the exit side of a plane common to the axes.

6. Apparatus according to claim 1 wherein the gear teeth are of sawtooth form, each tooth on each gear having a contact face disposed substantially radially of the respective gear axis and a sloping face.

7. Apparatus according to claim 6 wherein the peak-to-peak spacing between adjacent teeth on one gear is greater than the peak-to-peak spacing between adjacent teeth on the other gear.

8. Apparatus according to claim 1 wherein the first gear has a diameter greater than the diameter of the blank, and the second gear and the roll are of substantially equal diameter.

9. Apparatus according to claim 1 wherein one of the gears is a driven gear relative to the other gear, and drag means coupled to the drive gear for preventing the driven gear from overrunning the other gear.

10. Apparatus according to claim 1 wherein one of the gears is a driving gear relative to the other gear, one of the blank and the roll being slightly different in size relative to the required size thereof for the number of teeth to be formed in the blank by the roll in the absence of the first and second gears, such size difference existing in such relation to the gears that the driven gear is loaded in response to said engagement in a direction about its axis effective to prevent the driven gear from tending to lead the other gear.

* * * * *